US005110014A

United States Patent [19]

Doundoulakis

[11] Patent Number: 5,110,014

[45] Date of Patent: May 5, 1992

[54] BI-STABLE PRESSURE MAINTAINING GAS CONTAINERS

[76] Inventor: George J. Doundoulakis, 2498 Kayron La., North Bellmore, N.Y. 11710

[21] Appl. No.: 610,820

[22] Filed: Nov. 7, 1990

[51] Int. Cl.[5] ..... B65D 83/00

[52] U.S. Cl. ..... 222/396; 222/399; 261/DIG. 7

[58] Field of Search ..... 222/394-399, 222/129.1, 52, 400.7; 261/DIG. 7; 239/308, 346; 137/505.25

[56] References Cited

U.S. PATENT DOCUMENTS

| | | | |
|---|---|---|---|
| 3,161,324 | 12/1964 | O'Neill | 222/399 X |
| 3,214,061 | 10/1965 | Mills | 222/399 X |
| 3,217,947 | 11/1965 | Bauerlein | 222/399 X |
| 3,243,065 | 3/1966 | Wilson | 222/399 X |
| 3,403,820 | 10/1968 | Landis et al. | 222/396 X |
| 3,411,669 | 11/1968 | Puster | 222/399 X |
| 3,613,954 | 10/1971 | Bayne | 222/399 X |
| 3,995,778 | 12/1976 | Gamadia | 222/399 |
| 4,310,108 | 1/1982 | Motoyama et al. | 222/399 X |
| 4,456,155 | 6/1984 | Miyata et al. | 222/396 |
| 4,679,602 | 7/1987 | Hollis et al. | 261/DIG. 7 |
| 4,982,879 | 1/1991 | Corrado et al. | 222/399 X |
| 4,995,533 | 2/1991 | Vandoninck | 222/399 X |

*Primary Examiner*—Donald T. Hajec
*Assistant Examiner*—Kenneth DeRosa

[57] ABSTRACT

The object of this invention is to provide vessels for storing a gas to be used for automatically maintaining a predetermined pressure inside a container carrying a liquid, as it would be a beverage containing bottle. Two embodiments of such vessels are presented: One in shape of a capsule which can be dropped inside a beverage bottle, the other in the form of a cartridge which is attached at the bottom of a container, such as a beverage bottle. Both embodiments turn off gas flow when they sense a pressure equal or lower than atmospheric, or higher than a pressure of a predetermined value.

18 Claims, 3 Drawing Sheets

BI-STABLE PRESSURE MAINTAINING GAS CONTAINERS

TECHNICAL FIELD

The present invention relates in general to gas containers and in particular to vessels for storing a gas at a relatively high pressure and for feeding the gas to a container holding a liquid; with the added capability of self flow rate control for shutting-off when the vessel's internal mechanism senses a pressure close to atmospheric or higher than a predetermined pressure value; thereby, such vessels can be used for automatically maintaining a predetermined pressure in a container carrying the liquid, for preserving the quality of the liquid or for propelling flow of the liquid from its container.

BACKGROUND ART

While the proposed gas storage vessels may be applied in automatically maintaining a particular pressure in items such as cans and other types of containers for dispensing or spraying fluids, and even for blowing automobile tires, an immediate need appears to exist in the field of carbonated beverages; therefore, the description is presented in terms of examples relating to beverages.

Carbonated beverages contain $CO_2$ gas dissolved in the liquid of the beverage. It is the $CO_2$ gas that makes a cold drink particularly refreshing. These carbonated beverages are, for the most part, packaged in thin plastic containers made out of ethylene terephthelate and shaped in the form of bottles, with a standard metal cap covering the opening at the top, (the "conventional" bottle). Each time the beverage container is opened, the $CO_2$ gas at the top of the container escapes, reducing the pressure at the surface of the liquid to atmospheric. The pressure remains atmospheric as long as the bottle remains uncovered, while continuing to lose $CO_2$ bubbles from the body of the beverage. After replacement of the cap, $CO_2$ gas from the remaining beverage continues to escape into the space over it, but at a rate which is slowing down as a pressure equilibrium inside the container is approached, at a pressure lower than before opening the bottle. Further, with each opening and with beverage being consumed, a greater volume is left in the container to be filled with the $CO_2$ gas escaping from the smaller amount of remaining fluid.

Depending on the time lapse between openings, the time the bottle remains open, and the amount of beverage dispensed each time, the beverage may be depleted of its $CO_2$ gas to a lesser or greater extent and lose its refreshing quality, the beverage becoming "flat".

Part of the problem has been given a solution, but only for the case of the seltzer water in terms of two commercially available dispensers: (1) the traditional "seltzer bottle" and (2) the "Soda Spritzer Bottle".

In both types of bottles the seltzer water is made by mixing water and $CO_2$ at a relatively high pressure of about 7 atm. (kg/cm$^2$). As these bottles, while they are being filled, must withstand much higher gas pressures than commercial plastic beverage containers, they need to be stronger, and heavier and are, therefore, more expensive. The traditional seltzer bottle consists of a thick glass bottle capped with a cap that provides a spout, a lever-operated valve for dispensing the beverage and a syphon tube reaching near the bottom of the bottle. During manufacture the seltzer water is produced by simultaneously feeding water and $CO_2$ gas under a pressure of about 7 atm (kg/cm$^2$) into the seltzer bottle. The empty seltzer bottle is returned to the manufacturer for refill.

The soda spritzer bottle comprises a container made of aluminum with a wall thickness of about ⅛ inch, (0.3175 cm) and also provides a spout, a valve handle and a syphon, as in the case of the traditional seltzer bottle, for dispensing the beverage. In addition it provides a port for a disposable $CO_2$ cartridge. The consumer manufactures his own seltzer water by filling the container with water, then introducing $CO_2$ by puncturing of the cartridge. Additional cartridges must be purchased to make more seltzer. The improvement in these types of bottles over the conventional bottle is two-fold: (a) proportionately more $CO_2$ gas is packed into the seltzer water because of the higher pressure than can be withstood by the container, and (b) the cap remains "on" until the entire amount of beverage is consumed. Therefore, there is no loss of $CO_2$ gas due to the opening of the bottle, and the pressure in the empty region at the top of the bottle remains above atmospheric until the entire amount of beverage is dispensed. In both types of bottles the beverage is being dispensed when a hand-operated lever, positioned at the top of the bottle, opens communication between a spout extending from the bottle, and a syphon tube which extends to the bottom of the bottle. The pressure at the surface of the liquid in the bottle then forces the beverage to flow from the bottom of the bottle, through the syphon tube and the spout to the glass, while the gas, which is trapped at the top of the bottle, is preserved.

While the loss of the $CO_2$ gas through the process of opening the beverage bottle has been eliminated by the use of the above special containers, the amount of $CO_2$ per unit volume of liquid in the container is still being reduced every time beverage is withdrawn from the bottle. The reason is that for any volume of liquid lost from the bottle, there is an equal volume increase in the empty space at the top of the bottle. As this volume increases, its pressure is reduced and more $CO_2$ gas evaporates into it from the beverage, to keep the pressure at both sides of the liquid surface equal. The net effect is for the beverage to continuously lose $CO_2$ gas and become more and more "flat" as the amount of the beverage in the bottle reaches the end; although not as flat as in the case of the conventional bottles.

The thin plastic bottles made out of polyethylene terephthalate, used for most of the carbonated beverages are incapable of handling the high pressures of the seltzer of spritzer bottles. Since these beverages are packed with less $CO_2$ than found in either the seltzer or the spritzer bottles, and since they lose additional $CO_2$ with each opening of the bottle, a quick deterioration through depletion of the beverage's $CO_2$ gas occurs in the conventional commercial beverages.

In the case of non-carbonated wines it has been found that the natural taste of the wine can be better preserved when the empty space in the wine bottle is filled with Nitrogen gas rather than air.

In another patent application titled *Pressurizing Dispensers for Preserving Carbonation in Beverages*, Ser. No. 07/258893, filed Oct. 17, 1988, claims have been allowed covering an apparatus for dispensing a carbonated beverage from its own bottle while the bottle is covered by a special cap. The special cap with which the bottle's own cap is replaced upon opening the bottle, provides (1) an output port to which the dispensing apparatus can attached to a dispensing spout and on which it can apply a force for opening an internal valve to allow the beverage to flow to the spout and (2) an input port through which the dispensing apparatus feeds $CO_2$ gas at a predetermined pressure to fill in the volume generated inside the bottle as the beverage is being dispensed.

While the above dispensing apparatus can be functional in maintaining a desirable pressure inside a beverage bottle for preserving the taste and propel the beverage, it presents drawbacks in terms of the expense for the average consumer of acquiring such an apparatus and the nuisance of keeping an additional item on the top of the counter or the dining room table. In addition, the mechanics of having to operate an internal valve from outside the bottle also translate into cost.

A primary aim of the present invention is at providing simple means for correcting the problem of the $CO_2$ loss in carbonated beverages and especially in those sold already made in thin conventional plastic bottles, by maintaining proper pressure during and after dispensing of the beverage.

DISCLOSURE OF INVENTION

According to the first embodiment of the present invention, after the first glass of beverage is poured from a conventional beverage container, a capsule containing $CO_2$ under a higher pressure is inserted inside the container for maintaining proper pressure. The container's own cap is discarded and the container is covered by a special cap, comprising dispensing means so that the container can remain covered during subsequent dispensing events; while the gas from the capsule provides proper pressure and the propelling force needed for the beverage to move through a syphon and spout. Thereby, the invention helps the beverage retain its refreshing quality down to the last glass in the container. The capsule comprises an internal mechanism with a bi-stable valve, capable of self regulating gas flow for shutting-off gas release at atmospheric pressure and at a predetermined pressure at which the beverage is to be maintained.

In a second embodiment a cartridge containing $CO_2$ under high pressure is plugged-in on to the bottom of the beverage bottle connecting with the beverage though a check valve, for maintaining $CO_2$ pressure inside the beverage bottle as the beverage is being dispensed. As in the case of the first embodiment, the original cap of the bottle is discarded and the bottle is covered with the special cap, already described. The cartridge provides same bi-stable internal mechanism as in the case of the capsule for regulating gas flow and shutting-off at atmospheric pressure and at a higher predetermined pressure, which is to be approximately equal to the internal gas pressure in a beverage bottle before it is opened.

Accordingly, it is the main object of this invention to maintain a desirable gas pressure in a container holding a liquid, and for the purpose of preserving and/or propelling such liquid, by combining a self pressure regulating vessel containing the gas at high pressure with the beverage container.

It is a further object of this invention to provide, in combination with a gas-containing vessel, an inexpensive bottle cap, as shown in FIGS. 2 and 3, for replacing the bottle's own cap in covering the conventional beverage bottle as soon as is opened, and until its beverage has been consumed; such new cap comprising a gas output port connected to a syphon tube, which extends to near the bottom of the bottle, and a spout with valve means for allowing and stopping dispensing of the beverage.

It is a further object of this invention to produce seltzer water in a conventional beverage bottle by partially filling the bottle with water then introducing $CO_2$ gas from a gas supply means such as a capsule or a cartridge containing $CO_2$ gas under higher pressure; with the pressure in the beverage being maintained through pressure regulator means in the gas supply means.

Another object of this invention is to provide the means for beverages such as beer, champagne and other conventional beverages, which come in containers other than conventional plastic bottles, namely cans and glass bottles, to be preserved without losing carbonation; thereby, upon opening of their cover, transferring such beverage into an empty conventional beverage bottle properly capped according to the present invention, and having $CO_2$ be provided from a gas capsule or cartridge, in accordance with the present invention, in same manner as described in the case of beverages coming in conventional plastic containers.

Another object of the present invention is to be used in maintaining pressure of a gas such as nitrogen inside a bottle containing wine for preserving its natural taste and preventing it from turning into vinegar.

Another object of the present invention is to provide internal pressure in terms of a non-polluting gas such as nitrogen for propelling liquids in spray cans, and/or dispensing bottles and other types of containers.

Other objects and features of the invention will appear as the description of the particular physical embodiments are selected to illustrate the invention processes. The various features of novelty, which characterize the invention, are pointed out with particularity in the claims annexed to and forming a part of this specification. In addition, for a better understanding of the invention, its operating advantages and specific objects attained by its use, references are made to the accompanying drawings and descriptive matter in which there are illustrated and described preferred embodiments of the invention.

The invention is illustrated disgrammatically in the accompanying drawings by way of examples involving carbonated beverages. The diagrams illustrate only the principles of the invention and how these principles are employed in this particular field of application. It is, however to be understood that the purely diagrammatic showing does not offer a survey of other possible constructions, and a departure from the constructional features, diagrammatically illustrated, does not necessarily imply a departure from the principles of the invention. For example, each of the valves and check-valves shown in the various configurations can be designed in various forms. Also the special cap, shown covering the containers in FIGS. 2 and 3 may be constructed in various ways, some of which are commercially available. It is, therefore to be understood that the invention is capable of numerous modifications and variations to those skilled in the art without departing from the spirit and scope of the invention.

In the accompanying drawings, forming part hereof, similar reference characters designate corresponding parts.

BRIEF DESCRIPTION OF DRAWINGS

The details of my invention will be described in connection with the accompanying drawings in which.

BEST MODE FOR CARRYING THE INVENTION

Figure 1:
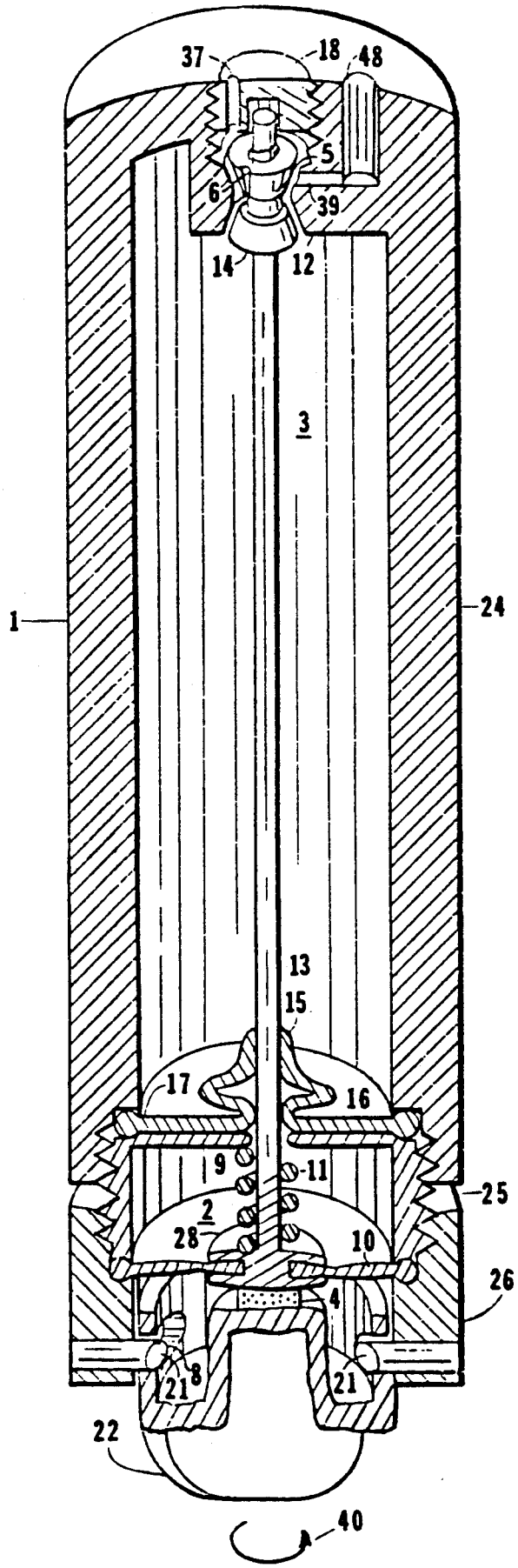
FIG. 1 is a cross-sectional, fractional, perspective elevation view showing the construction of a gas capsule representing the first embodiment of the invention.
Figure 2:
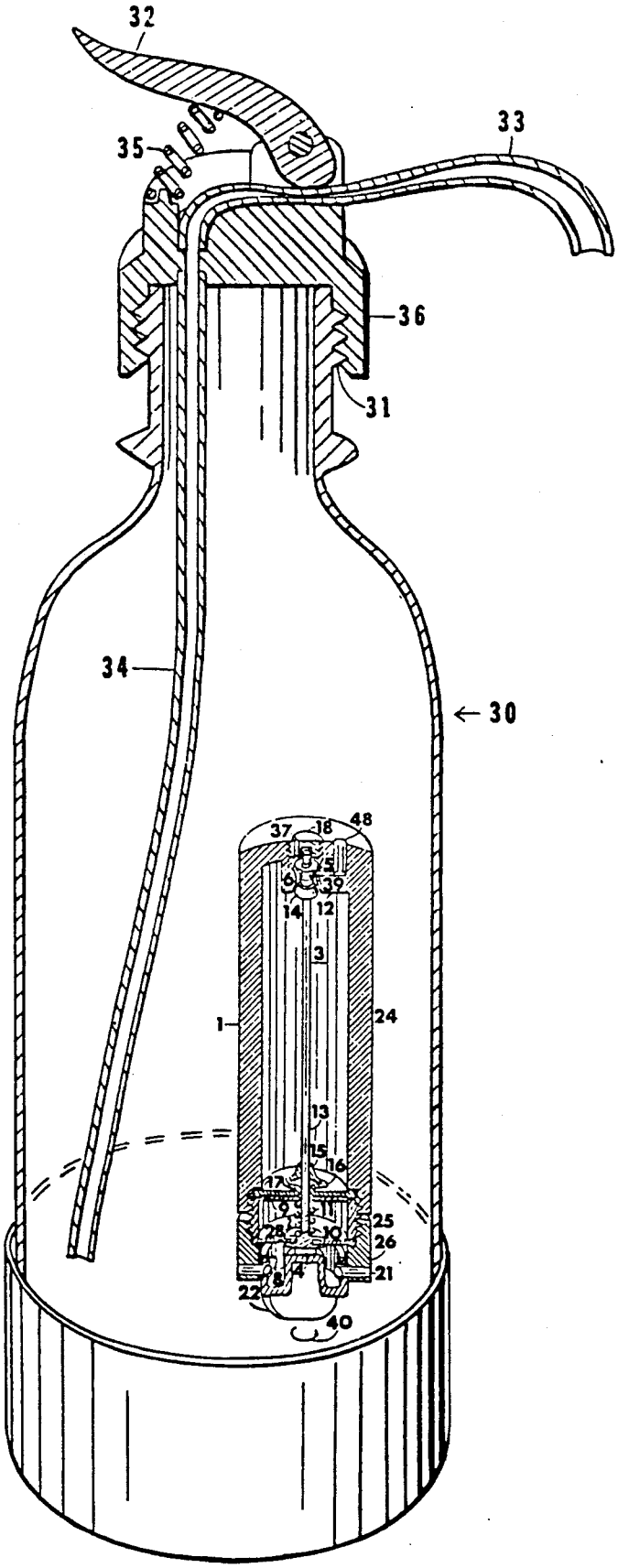
FIG. 2 is a perspective, mostly cross-sectional, elevation view of a conventional beverage polyethylene terephthelate bottle, covered with a special cap, comprising a spout with dispensing valve and syphon tube, and having inserted into it the capsule shown in FIG. 1, in accordance with the first embodiment of the invention.

Embodiment A is represented by a vessel in the shape of a capsule 1, for containing a gas at a pressure greater than atmospheric for the purpose of maintaining a predetermined pressure inside a container containing a liquid. Such capsule, shown in FIG. 1, will now be described for use inside a beverage bottle, as shown in FIG. 2.

The capsule 1, is substantially cylindrical in shape, with radius smaller than the opening of the conventional beverage bottle 30, so it can fit to be inserted, comprises a chamber 3, for containing a gas, such as $CO_2$ under relatively high pressure. The capsule 1 further comprises an internal self controlling mechanism for regulating the rate of gas release depending on a pressure external to the capsule. The chamber 3 is formed by a strong wall 24, which can be made out of plastic, out of metal or out of a clad combination of the two. The base of chamber 3, shown in FIG. 1 as the bottom of the chamber, is formed by the end 17 of a bellows 16, preferably made out of an elastomeric material. Such material can provide air-tight circumferential seal around the lower edge. as a cap 9 is screwed onto the wall 24 by use of a thread 25. The bellows 16 comprises a base 17, at least one convolution 16, and a tip 15 disposed in sliding contact with and around a pin 13, which runs along the axis of the capsule 1. The high gas pressure in chamber 3 tends to urge the wall of the tip 15 towards the wall of the pin 13, thereby providing a tight seal for the high pressure along the tip of the bellows.

Within the wall of the other base, shown at the top of the chamber 3, is provided a dual valve housing 12, in which operate two oppositely directed valves, valve 5 and valve 14, rigidly supported by the pin 13. When the pin 13 is displaced upwardly the valve 14 comes in contact with the lower portion of the valve housing 12, sealing off the gas in chamber 3 from escaping through an output port 48. Conversely, with the pin 13 displaced downwardly, the valve 5 comes in contact with the upper portion of the valve housing 12, sealing off the gas in chamber 3 from escaping through a tunnel 39, which has its input opening on the upper side wall of the valve-housing 12 and is connected to the output port 48. A groove 6 along the surface of the valve 5 serves to allow the high pressure to equalize around the valve 5, so that the valve 5 can be urged towards the opening of the tunnel 39 on the conical side of the upper portion of the valve housing 12; thereby sealing off the opening.

The lower end of the pin 13 is formed into a head 28 with a circumferential slot so it can crimp onto a flexible membrane 10. This membrane then, which provides circumferential seal around the edge of the cap 9 as a cylindrical member 26 is tightened by use of the thread 25, forms a sealed off base to a second chamber 2, which is to provide atmospheric pressure reference. The pin head 28, and therefore the membrane 10 are urged downwardly by a spring 11, so that when the lower surface of the membrane 10 is under atmospheric pressure, the pin 13 is similarly urged downwardly, bringing the valve 5 in contact with the upper conical surface of the valve housing 12 to block passage of the gas to the tunnel 39.

With the capsule 1 inside a beverage bottle 30, as the pressure in the bottle is raised it displaces the membrane 10 and pin 13 upwardly against the force of the spring 11, so that gas from the chamber 3 can reach the tunnel 39 and, therefore, the output port 48 into the bottle 30. However, when the pressure in the bottle, and the membrane 10 reaches a predetermined value—such as the value of the pressure in an un-opened carbonated beverage bottle—the resulting displacement of the pin is sufficient to bring the valve 14 up against the lower conical surface of the valve housing 12, sealing off chamber 3. The function of the bellows 17 is to expand or contract to permit axial motion of the pin 13, while keeping the gas in chamber 3 from leaking into the chamber 2.

The sequence in assembling the gas capsule starts with assembling the components to be mounted around the pin 13. First the elastomeric membrane 10 is inserted and crimped on to the pin head 28. Next the spring 11 is inserted around the pin 13, followed by the cap 9, and the bellows 17. Before the valve 14 is mounted, a lock-washer (not shown) is snapped into a transverse slot pre-machined at a predetermined position on the pin 13. The valve 14 is then mounted and a second lock-washer is inserted next to the top base of the valve 14 to secure the position of the valve on to the pin. The pin assembly is next inserted into the cylindrical wall 24 and the cap 9 screwed on to the wall 24, while, at the same time circumferentially compressing the edge of the bellows' base 17 to form an effective seal.

The valve 5 is next mounted, also with the use of lock-washers next to bottom and top bases of the valve 5. This operation is accomplished through an opening left at the top of the capsule when its cover 18 is removed. The cover 18 is then used to cover the opening and to provide a centering bearing surface to the end of the pin 13; while the bearing also allowing axial movement to the pin.

Next, the edge of the membrane 10 is circumferentially secured along the lower edge of the cap 9 by tightening the cylindrical member 26 over the cap 9 also using the thread 25.

Finally, the locking cap 22, with a spring cushion 4 already cemented in place, is fitted inside the cylindrical end member 26, where it is secured by pressing two pins 21 into slots 8. The slots 8 provide notches, (not shown), corresponding to three distinct axial positions for the cap. The first position with the cup turned all the way clockwise, in the direction of the arrow 40, brings the cup 22, and therefore, the spring cushion 4 away from the pin head 28, so the position of the pin 13, and therefore the valves 5 and 14, is solely determined by the pressure exerted on the membrane 10. The second position brings the cap 22 further inside the capsule to slightly push the pin head 28 through the spring cushion; this brings the valves 5 and 14 half way inside the valve housing, permitting communication between the port 48 and the inner space of chamber 3.

While a capsule 1 is being charged with gas and while waiting before being inserted into a bottle, the pin 13 can be secured forwardly by turning the cap 22 all the way counter-clock wise; thereby pressing the cushion 4 against the pin head 28 and causing the valve 14 to seal off the high pressure chamber. With the cap 22 at this position, the gas capsule 1 can be recharged through the port 48 as the higher entering pressure can displace the valve 14 while further compressing the cushion 4, for the new charge to enter the capsule.

Wile the capsule 1 is being stored, it may be kept in a protective cylindrical case or wrapper (not shown) to stay clean from dust and handling. Prior to inserting a capsule into a bottle, the locking cap 22 is turned all the way clockwise to allow the bi-stable valve to operate freely. Then, and until the capsule is inserted in the bottle and until the bottle is capped, the pressure acting on the membrane 10 is close to atmospheric, so that the output port is closed by the valve 5 and only a small amount of leakage from the capsule is allowed through a pinhole 37. The purpose of this hole is to help expedite the buildup of pressure inside the bottle so that the bi-stable valves can fully operate to quickly adjust the pressure inside the bottle to the predetermined pressure.

FIG. 2 shows a beverage bottle 30 containing beverage 50 with a capsule 1 placed into the bottle at the time the first glass of beverage was withdrawn from the bottle.

The bottle 30 is shown in FIG. 2 to be covered with a special cap 36, different than its original cap. The new cap 36 provides a standard thread 42 to fit the bottle's own thread. The cap is further comprising a syphon tube 34, which extends from the cap's output port 38 to near the bottom of the bottle 30. An elastomeric spout 33 extends from the external side of the port 38, for concentrating the dispensing of the beverage into a glass. A thumb operated lever 32 serves to allow flow of the beverage to the spout. The lever 32 is spring loaded by a spring 35 capable of returning the lever 32 to its normal position, where a tubule leading to the spout, is pinched by the acentric end of the lever 32. As previously stated, the capsule 1 provides automatic control in maintaining the pressure inside the bottle 30 at a predetermined level. This pressure, which is close to the pressure in the beverage bottle before it is opened, helps maintain full carbonation in the beverage and also provides propelling force for the dispensing of the beverage through the syphon 34 and spout 33.

Figure 3:
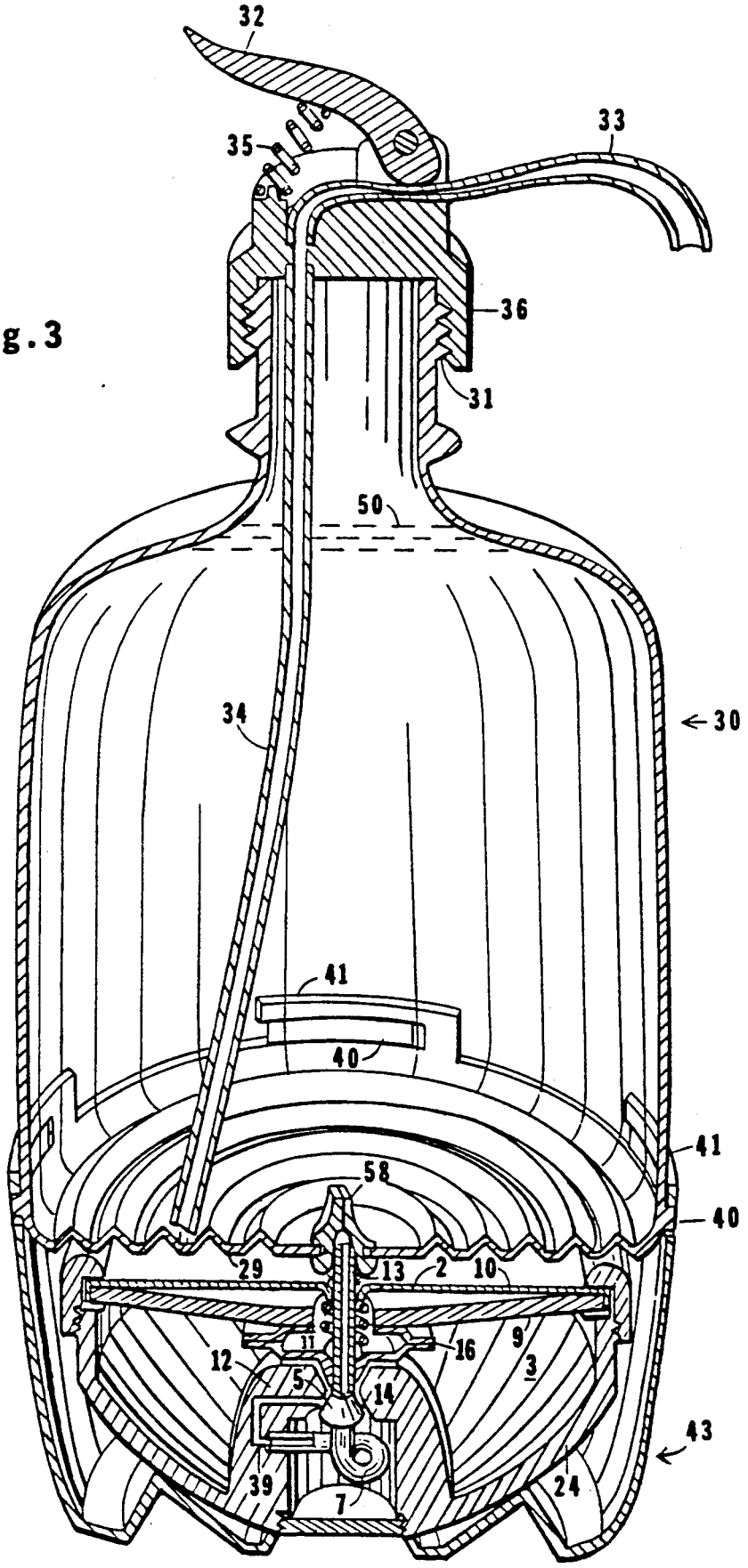
FIG. 3 is a perspective, mostly cross-sectional, elevation view of a beverage container covered with a special cap, comprising a spout with dispensing valve and syphon tube, and having plugged into its lower portion through a check valve a cartridge, in accordance with the second embodiment of the invention.

Embodiment B, is shown illustrated in FIG. 3, comprising a gas cartridge 43 latched onto the bottom of a special plastic beverage bottle 30 for maintaining optimum pressure inside the bottle. The topological design of the cartridge 43 is same as that of the capsule 1, described above, with corresponding parts identified by same numbers.

The greater portion of the volume of the cartridge 43 is occupied by a high pressure chamber 3, bounded by a wall 24 and a rigid base 9. An atmospheric reference chamber 2, is formed between the base 9 and a membrane 10. A pin 13, here in the form of a hollow tube, serves to hold valves 5 and 14, which operate inside a dual valve housing 12. A small variation here from the design of the capsule 1, provides for the valve 14 to be formed out of the tip of the bellows 16. The pin 13, here implemented in terms of a hollow tube, runs along the axis of the cartridge 43. Besides carrying the valves 5 and 14, the pin 13 is also operable to conduct gas from the lower end, which is connected to an output channel 39 though a tubule 7 to the top end, which plugs into an elastomeric check valve 58. Assembly is accomplished as the cartridge is pushed and turned to latch around the bottom of the bottle 30, while vanes 41 slide over protrusions 40.

The operation of the cartridge 43 is substantially same as that of the capsule 1, with the exception that instead of the pressure in the bottle 30 acting directly on the membrane 10, it here acts via the bottom of the bottle 30, which provides undulations 29 to render it flexible. At atmospheric pressure, a condition which exists before the cartridge is plugged into the bottle or before the bottle is filled with beverage, the valve 5 blocks the flow of gas to the tunnel 39; therefore the cartridge is shut-off. With the bottle 30 filled with beverage, the membrane 10 senses the additional pressure, which causes it to be displaced down wardly; thereby positioning the valves 5 and 14 away from direct contact with the dual valve housing 12, allowing space for the gas in chamber 3 to flow to the channel 39, and from there, through a flexible tube 7, the pin 13 and the check valve 58 to the interior of the bottle 30. When the pressure inside the bottle 30 reaches a predetermined value, the bottom of the container exerts a force onto the membrane 10 and pin 13 are further displaced downwardly against the force of the spring 11 for the valve 14 to seal off chamber 3 and therefore shutoff further flow. The function of the bellows 16 here is same as in the described capsule, to allow axial displacement of the hollow pin 13; while preventing gas from the high pressure chamber 3 to escape to the atmospheric reference chamber 2.

The cartridge 43 may be latched to the bottle 30 at the factory even before the bottle is filled, or at the time the consumer exchanges the bottles own cap with a special cap 36. The cap 36, providing a syphon and spout with dispensing valve has been described in connection with the bottle 30 in which a capsule 1 is inserted.

The cartridge 36 can be easily refilled with gas through the tip of the hollow pin 13.

I claim:

1. A vessel for storing and releasing a gas for maintaining a pre-determined pressure in a container carrying a liquid and being disposed in close proximity to said vessel; said vessel comprising:

a particular gas to be stored and be released to said container by said vessel;

a high pressure chamber inside said vessel for containing said gas at relatively high pressure, compared to atmospheric pressure;

pressure sensing means for detecting a pressure external to said vessel, relatively to atmospheric pressure;

gas flow control means for allowing flow of said gas from said high pressure chamber to said container;

automatic control means connecting said sensing means with said gas flow control means;

said flow control means comprising:

dual valve housing means and bi-directional valve means, the latter operable in said dual valve housing means, for allowing flow of said gas while said sensing means detects a pressure within a predetermined pressure range and for shutting off gas flow when said sensing means detects a pressure either lower or higher than the predetermined pressure range;

whereby, said vessel provides high pressure storage of a gas, the releasing of which being automatically monitored for maintaining in a container holding a liquid, a predetermined pressure level.

2. The gas storage vessel according to claim 1, wherein said valve means comprises: a first valve operable to entirely close a first section of said dual valve housing means, and a second valve means, operable in closing a tunnel, which has its end at an opening on the wall of a second section of said bi-directional valve housing.

3. The gas storage vessel according to claim 2, wherein said second valve means is further comprising a groove for allowing the pressure in said high pressure chamber to reach and impinge on the surface of said second valve means; thereby urging said valve towards the tunnel opening for effectively blocking gas flowing through the tunnel when said pressure sensing means detects a pressure approximately equal to or less that atmospheric.

4. The gas storage vessel according to claim 1, wherein said pressure sensing means includes an atmospheric pressure reference chamber for providing to said pressure sensing means reference to atmospheric pressure; thereby said gas storage vessel being adjusted to shut off release of gas at a pressure approximately equal to or lower than atmospheric pressure.

5. The gas storage vessel according to claim 4, wherein said pressure sensing means includes a flexible membrane.

6. The gas storage vessel according to claim 5, wherein said flexible membrane also provides a base to said atmospheric reference chamber.

7. The gas storage vessel according to claim 6, wherein said atmospheric reference chamber further comprises an internal spring for urging said membrane against a force on said membrane due to a pressure external to said vessel.

8. The gas storage vessel according to claim 5, wherein said flexible membrane is connected with said valve means; thereby said valve means is positioned with respect to said valve housing means and gas flow is being adjusted in accordance with a total stress on said flexible membrane.

9. The gas storage vessel according to claim 8, wherein connection between said flexible membrane and said valve means is implemented by an axially disposed pin, which is also used for carrying said valve means and for keeping said valve means substantially centered with respect to said valve housing means.

10. The gas storage vessel according to claim 9, further comprising a flexible bellows for providing air-tight seal between said high pressure chamber and said atmospheric reference chamber and also for providing a sliding air-tight contact with said pin as said pin with said valve means are axially displaced depending on total stress on said membrane:

11. The gas storage vessel according to claim 9, wherein said pin is movably supported at one end by a centering bearing for keeping the pin centered and for allowing axial movement to the pin as the force on said flexible membrane, due to an external pressure, varies.

12. The gas storage vessel according to claim 11, further comprising latching cap means covering one end of said vassel and providing three latching rotations, a first rotation locking said first valve means to remain in contact with said first section of said valve housing means for preventing leackage of said gas from said vassel; a second rotation, where said valve means are locked at a position allowing space between said valve means and said valve housing means for said gas to be allowed to flow, while the external pressure remains substantially atmospheric; and a third rotation at which no contact is made between said latching cap means and said flexible membrane; therefore, the position of said valve means is solely determined by said pressure sensing means.

13. The gas storage vessel according to claim 12, wherein said latching cap means is further comprising a spring cushion, operable to spring load said membrane with a predetermined force when said latching cap is set at a first rotation, while said spring cushion permitting additional displacement of said valve means, suficient for gas to enter said high pressure chamber when said vessel is connected for being recharged to a high pressure source.

14. The combination of said gas storage vessel according to claim 10 and a bottle, wherein said gas storage vessel is in the form of a cartridge externally attached to a bottle.

15. The combination according to claim 14, wherein the bottle further comprises a flexible base, which can behave as a flexible membrane as is acted upon by pressure inside the bottle; and further comprising a check valve for permitting a one-way flow of gas from said vessel to the bottle.

16. The combination according to claim 15, wherein said axially disposed pin in said vessel is hollow for conducting gas between said tunnel opening, which is being connected to one end of said pin by a tubule and other end of said pin, which connects to said check valve of the bottle.

17. The combination according to claim 16, wherein said vessel, in the form of a cartridge is further comprising latching vane means, and wherein the bottle comprises protrusion means, for said vessel to be engaged and be disengaged from the battle.

18. The combination of the gas capsule and a beverage bottle as in claim 17, wherein the beverage bottle's own cap has been replaced by a special cap providing a syphon that reaches near the bottom of the bottle, a spring-loaded valve and a spout for dispensing the beverage without uncovering the bottle.

* * * * *